US011598130B2

(12) United States Patent
Sha et al.

(10) Patent No.: US 11,598,130 B2
(45) Date of Patent: Mar. 7, 2023

(54) HIDDEN HANDLE ASSEMBLY

(71) Applicant: Illinois Tool Works Inc., Glenview, IL (US)

(72) Inventors: Wenquan Sha, Shanghai (CN); Bin Chen, Shanghai (CN)

(73) Assignee: Illinois Tool Works Inc., Glenview, IL (US)

( * ) Notice: Subject to any disclaimer, the term of this patent is extended or adjusted under 35 U.S.C. 154(b) by 232 days.

(21) Appl. No.: 16/769,911

(22) PCT Filed: Dec. 21, 2018

(86) PCT No.: PCT/US2018/067280

§ 371 (c)(1),
(2) Date: Jun. 4, 2020

(87) PCT Pub. No.: WO2019/133524

PCT Pub. Date: Jul. 4, 2019

(65) Prior Publication Data

US 2021/0189778 A1 Jun. 24, 2021

(30) Foreign Application Priority Data

Dec. 25, 2017 (CN) ..... 201711423248.9

(51) Int. Cl.
*E05B 85/10* (2014.01)
*E05B 85/16* (2014.01)

(52) U.S. Cl.
CPC ..... *E05B 85/107* (2013.01); *E05B 85/16* (2013.01)

(58) Field of Classification Search
CPC ..... E05B 85/10; E05B 85/16; E05B 85/103; E05B 85/107
See application file for complete search history.

(56) References Cited

U.S. PATENT DOCUMENTS 10,294,692 B2 * 5/2019 Smart ..... E05B 5/003
10,731,389 B2 * 8/2020 Smart ..... E05B 85/107
(Continued)

FOREIGN PATENT DOCUMENTS

CN 103339334 A 10/2013
CN 203835084 U 9/2014
(Continued)

OTHER PUBLICATIONS

International Search Report and Written Opinion of the International Searching Authority from corresponding PCT Application No. PCT/US2018/067280, dated Mar. 26, 2019 (9 pages).

*Primary Examiner* — Kristina R Fulton
*Assistant Examiner* — Emily G. Brown
(74) *Attorney, Agent, or Firm* — Quarles & Brady LLP

(57) ABSTRACT

A concealed handle assembly that includes a handle base and a handle body rotatable about a first axle such that one end of the handle body can extend or return to a concealed state, the first axle being disposed on the handle base, the handle body having a handle body initial position, a handle body first open position, and a handle body second open position. The assembly further includes a rocker arm rotatable about a second axle, the second axle being disposed on the handle base, the rocker arm having a rocker arm initial position, a rocker arm first open position, and a rocker arm second open position, the rocker arm being capable of being rotated away from or returned to the rocker arm initial position as the handle body rotates, the rocker arm being capable of driving a bolt.

20 Claims, 17 Drawing Sheets

(56) References Cited

U.S. PATENT DOCUMENTS

| | | | | |
|---|---|---|---|---|
| 10,954,702 | B2 * | 3/2021 | Couto Maquieira | E05B 81/16 |
| 2014/0300115 | A1 | 10/2014 | Vasi et al. | |
| 2017/0089102 | A1 * | 3/2017 | Yoshino | E05B 77/32 |
| 2017/0260780 | A1 * | 9/2017 | Christensen | E05B 85/103 |
| 2018/0058113 | A1 * | 3/2018 | Han | E05B 85/103 |
| 2019/0234122 | A1 * | 8/2019 | Löw | E05B 85/103 |
| 2019/0284847 | A1 * | 9/2019 | Malvy | E05B 81/06 |
| 2020/0071973 | A1 * | 3/2020 | Han | E05F 15/603 |
| 2021/0156178 | A1 * | 5/2021 | Heyduck | E05B 81/42 |
| 2021/0363794 | A1 * | 11/2021 | Rhein | E05B 81/90 |

FOREIGN PATENT DOCUMENTS

| | | | |
|---|---|---|---|
| CN | 104812979 | A | 7/2015 |
| CN | 106256982 | A | 12/2016 |
| CN | 205970769 | U | 2/2017 |
| CN | 206190064 | U | 5/2017 |
| CN | 106948684 | A | 7/2017 |
| EP | 3147436 | A1 | 3/2017 |
| GB | 2506350 | A | 4/2014 |
| GB | 2536669 | B | 3/2018 |
| JP | 6078647 | B2 | 2/2017 |
| WO | 2016151131 | A1 | 9/2016 |

* cited by examiner

HIDDEN HANDLE ASSEMBLY

CROSS REFERENCE TO RELATED APPLICATIONS

The present application represents the United States National Stage of International Application No. PCT/US2018/067280, filed Dec. 21, 2018, which claims priority to, Chinese patent application number 201711423248.9, filed Dec. 25, 2017, the entire contents of which are incorporated by reference in their entirety.

FIELD OF THE INVENTION

The present invention relates to the field of handle assemblies, and more particularly to a concealed handle assembly.

BACKGROUND

Conventional handles often protrude from the door panel and there is space between the handle and the door panel that can accommodate a user's hand. When the door needs to be opened, the user extends his/her hand into the space and pulls the handle to open the door. However, the handle protruding from the door panel is prone to collide with other objects or people and can be damaged, which shortens its service life. Especially when used in a vehicle, the vehicle handle protruding from the door panel additionally increases the wind resistance for the vehicle during travel.

Therefore, there is a need for a concealed handle assembly having an outer surface that is substantially flush with the door panel, thus making the door panel smooth and aesthetically pleasing. This not only prevents the handle from collision due to protrusion from the surface of the door panel, ensuring that it has a long service life, but also reduces the wind resistance for a vehicle when it is used in the vehicle. In addition, it is expected that the concealed handle assembly is simple and reliable in structure while being convenient to operate.

SUMMARY OF THE INVENTION

Exemplary embodiments according to the present invention may solve at least some of the above problems.

The present invention provides a concealed handle assembly, comprising a handle base, a handle body, the handle body being rotatable about a first axle such that one end of the handle body can extend or return to a concealed state, the first axle being disposed on the handle base, the handle body having a handle body initial position, a handle body first open position, and a handle body second open position, and a rocker arm, the rocker arm being rotatable about a second axle, the second axle being disposed on the handle base, the rocker arm having a rocker arm initial position, a rocker arm first open position, and a rocker arm second open position, the rocker arm being capable of being rotated away from or returned to the rocker arm initial position as the handle body rotates, the rocker arm being capable of driving a bolt. When the rocker arm is rotated by a first predetermined angle in a first direction from the rocker arm initial position, the handle body reaches the handle body first open position, when the rocker arm continues to rotate by a second predetermined angle in the first direction from the first predetermined angle, the handle body reaches a handle body second open position, and in the handle body second open position, the rocker arm can drive the bolt to unlock.

According to the above-mentioned handle assembly, the concealed handle assembly comprises a driving device, which is capable of driving the handle body to rotate about a first axle, thereby driving the rocker arm to rotate, and a first energizing device that, when the rocker arm is rotated from the rocker arm initial position to the rocker arm first open position, is caused to generate a stop signal, thereby stopping the driving device.

According to the above-mentioned handle assembly, the concealed handle assembly comprises a second energizing device that, when the rocker arm returns from the rocker arm first open position to the rocker arm initial position, is caused to generate a stop signal, thereby stopping the driving device.

According to the above-mentioned handle assembly, the concealed handle assembly comprises a torsion spring, configured to apply a deflection force to the rocker arm, one end of the torsion spring being connected to the handle base and the other end to the rocker arm.

According to the above-mentioned handle assembly, the concealed handle assembly comprises a slider, which is driven by the driving device and is configured to push the handle body such that the handle body rotates from the handle body initial position to the handle body first open position.

According to the above-mentioned handle assembly, the rotation of the handle body from the handle body first open position to the handle body second open position is generated by a force applied from the outside.

According to the above-mentioned handle assembly, the handle body comprises a contact portion, which is in contact with the rocker arm such that when the handle body is rotated, the handle body applies a rotational force to the rocker arm.

According to the above-mentioned handle assembly, the slider comprises a bevel, which is in contact with the handle body such that the handle body is rotatable about the first axle when the slider is linearly moved.

According to the above-mentioned handle assembly, the handle assembly comprises a starting device, which starts the driving device in response to an external force applied to the handle body.

According to the above-mentioned handle assembly, the handle assembly comprises a returning device, which starts the driving device in response to an external force applied to the returning device, so that the handle body returns from the first open position to the initial position.

According to the above-mentioned handle assembly, the slider comprises an additional rotating block and a slider holder, the additional rotating block being disposed on the slider holder, the additional rotating block comprising the bevel, wherein the additional rotating block is linearly movable with the slider holder, enabling the handle body to rotate about the second axle through the bevel when it is desired to return the handle body from the handle body first open position to the handle body initial position, an external force can be applied to the handle body to cause the handle body to rotate the additional rotating block, thereby starting the driving device, so that the handle body returns from the handle body first open position to the handle body initial position.

According to the above-mentioned handle assembly, the slider holder is provided with a third axle, the additional rotating block being disposed on the slider holder, the additional rotating block being rotatable about the third axle.

According to the above-mentioned handle assembly, the first energizing device and the second energizing device are contact sensors.

According to the above-mentioned handle assembly, the driving device is a motor.

BRIEF DESCRIPTION OF THE DRAWINGS

These and other features and advantages of the present invention will be better understood from the following detailed description in conjunction with the attached drawings. In the drawings, the same reference numerals are used for the same components, wherein.

SPECIFIC EMBODIMENTS

Figure 1A:
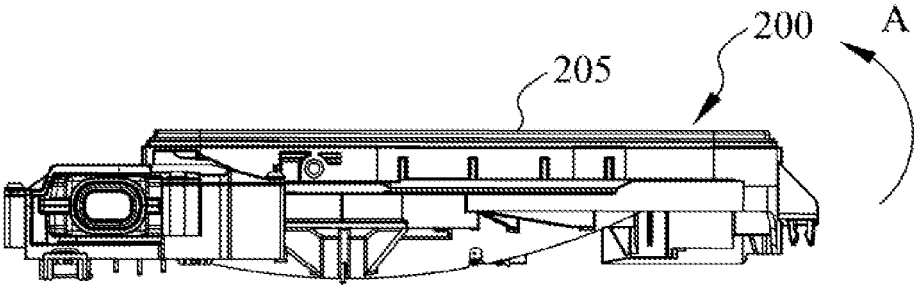
FIG. 1A is a lateral view of a handle 205 of a handle assembly 200 in a handle initial position according to an embodiment of the present disclosure.

Various specific embodiments according to the present disclosure will be described below with reference to the drawings which form a part of this specification. It should be understood that although terms referring to directions, such as "front", "back", "upper", "lower", "left", "right", etc. are used to describe or illustrate the various example structural components and elements according to the present invention, these terms are used herein for purposes of illustration only, and are based on the example orientation shown in the figures. Since the embodiments disclosed herein may be arranged in different orientations, these terms are merely illustrative and are not to be considered as limiting. In the following figures, the same components are denoted by the same reference numerals, and similar components are given similar reference numerals.

Figure 1B:
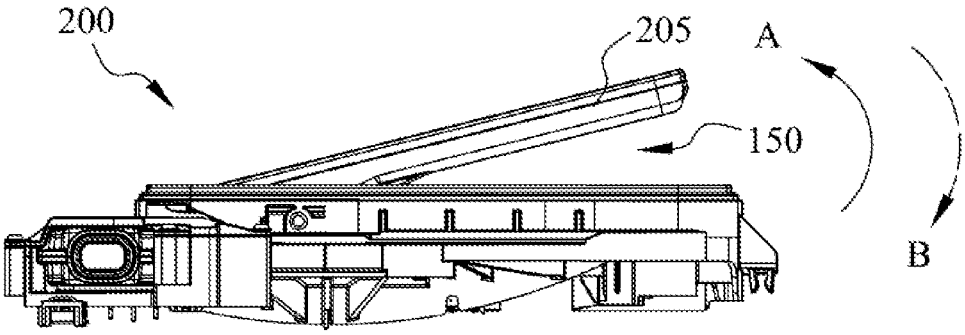
FIG. 1B is a lateral view of the handle 205 shown in FIG. 1A in a handle first open position.
Figure 1C:
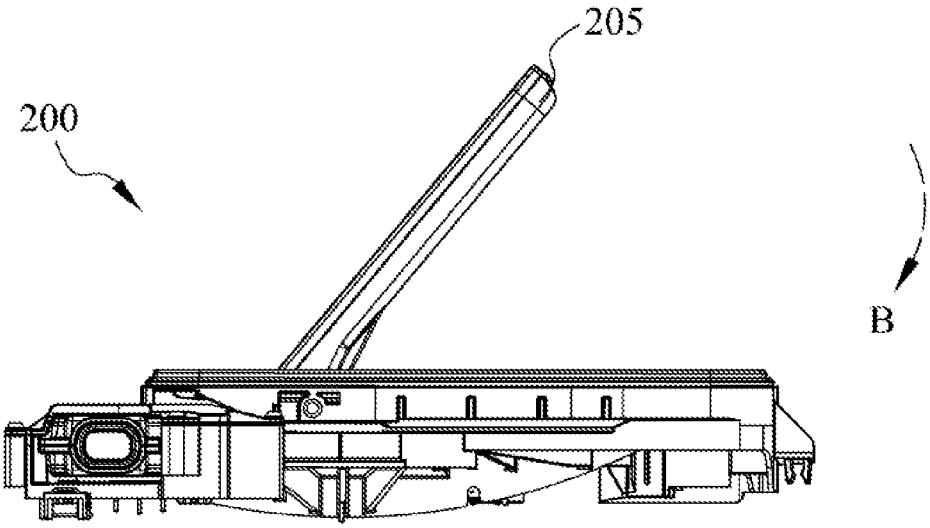
FIG. 1C is a lateral view of the handle 205 shown in FIG. 1A in a handle second open position.

FIG. 1A is a lateral view of the handle 205 (see FIG. 3) of the handle assembly 200 in a handle initial position according to an embodiment of the present invention. FIG. 1B is a lateral view of the handle 205 of the handle assembly 200 shown in FIG. 1A in a handle first open position. FIG. 1C is a lateral view of the handle 205 of the handle assembly 200 shown in FIG. 1A in a handle second open position. Specifically, when the user does not wish to open the door, the handle 205 can be in a handle concealed state (i.e., the handle initial position shown in FIG. 1A); in this case, the surface of the handle 205 is flush with the door panel, so that the handle 205 does not protrude from the door panel. When the user wishes to open the door, the following operations can be performed: the user presses the handle 205 to rotate the handle 205 in a first direction (i.e., the direction indicated by the solid line A in FIG. 1A) by a first predetermined angle, thereby causing one end of the handle 205 to extend outward, reaching the handle first open position shown in FIG. 1B. In the first open position, an operating space 150 in which a hand can be extended is formed between the handle 205 and the door panel. Then, the user extends his/her hand into the operating space 150 to pull the handle 205, and the handle 205 continues rotating in the first direction, so that the handle 205 reaches the handle second open position shown in FIG. 1C. At this point, the door lock is opened and the user can pull the door open. When the door is opened, the user can rotate the handle 205 in a second direction (i.e., the direction indicated by the broken line B in FIG. 1C) by pressing the handle 205, thereby returning to the concealed state (i.e., the handle initial position in FIG. 1A).

Figure 2A:
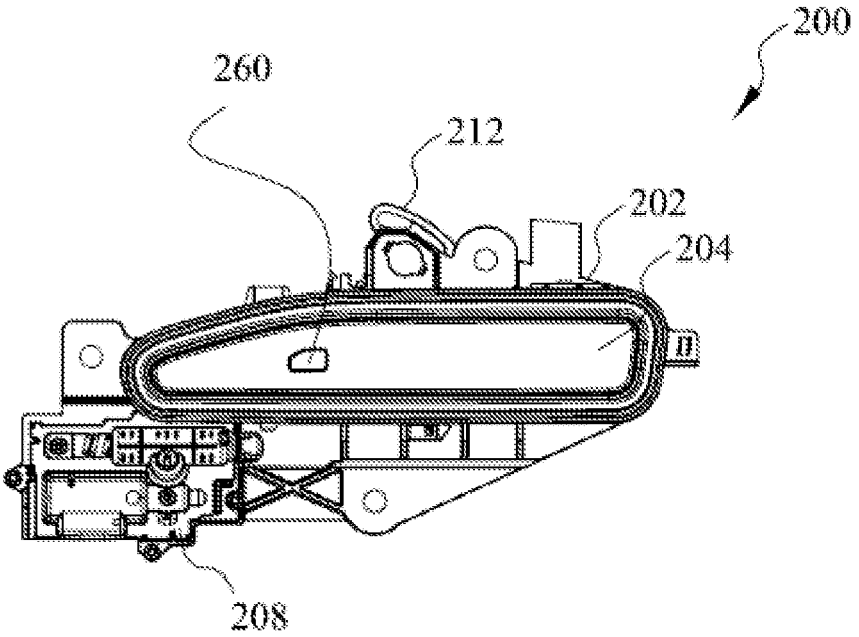
FIG. 2A is a front view of the handle 205 of the handle assembly 200 in the handle initial position according to an embodiment of the present disclosure.
Figure 2B:
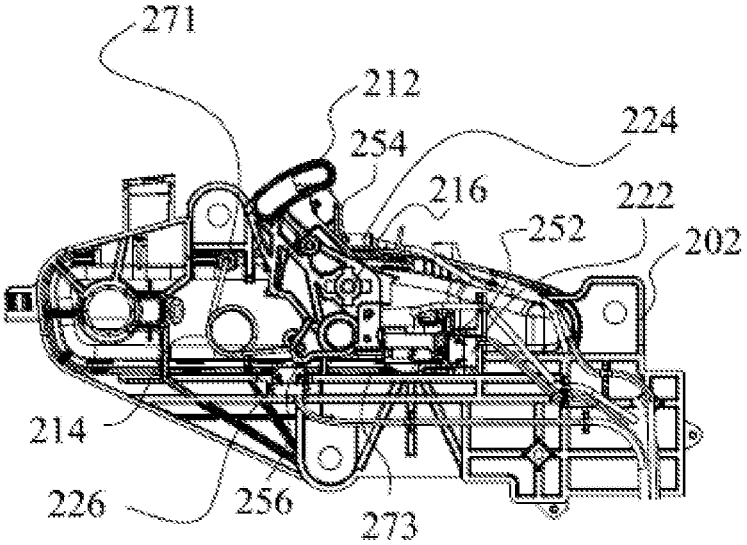
FIG. 2B is a rear view of the handle 205 shown in FIG. 2A in the handle initial position.
Figure 3:
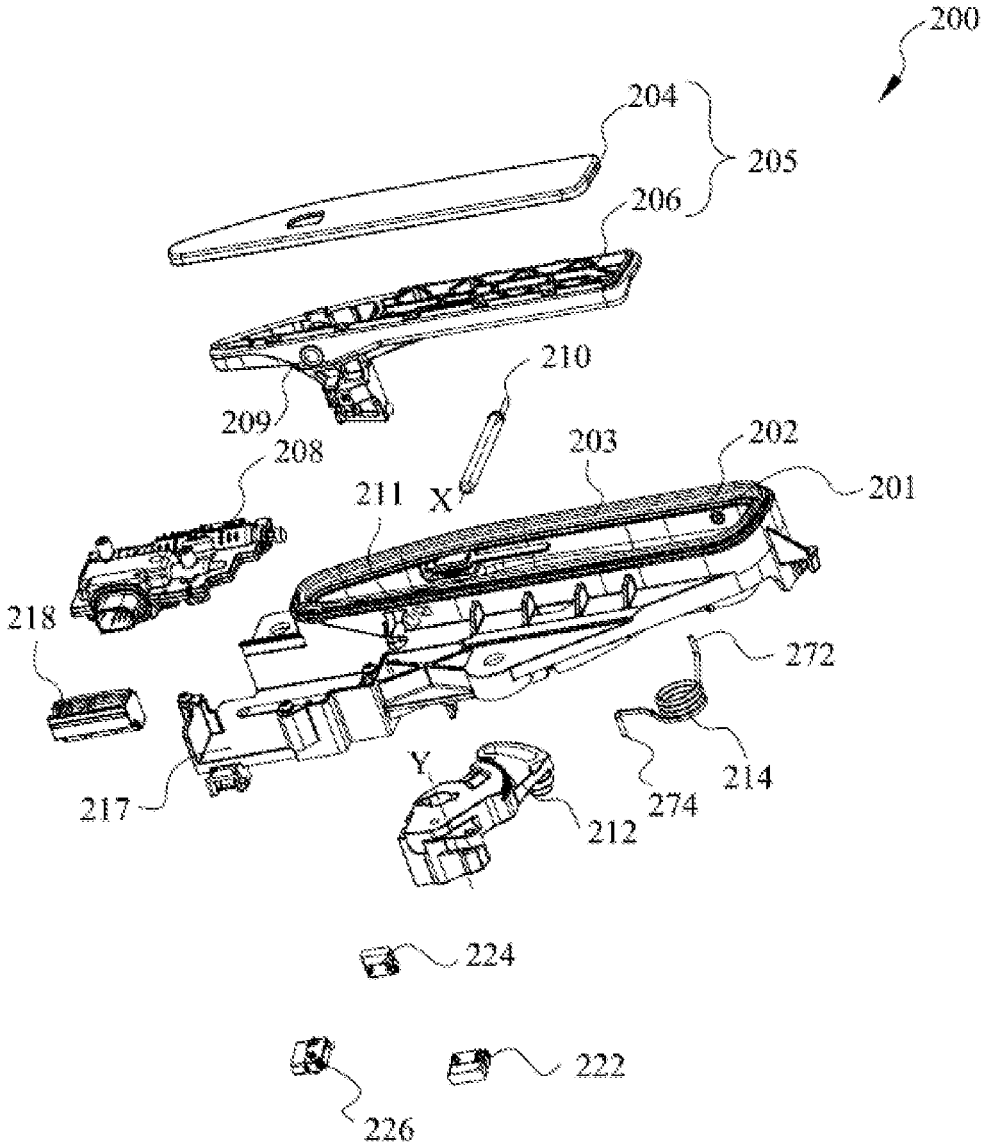
FIG. 3 is an exploded view of the handle assembly 200 shown in FIG. 2A.

FIG. 2A is a front view of the handle 205 of the handle assembly 200 in a handle initial position according to an embodiment of the present invention. FIG. 2B is a rear view of the handle 205 of the handle assembly 200 shown in FIG. 2A in a handle initial position. FIG. 3 is an exploded view of the handle assembly 200 shown in FIG. 2A. As shown in FIGS. 2A, 2B and 3, the handle assembly 200 comprises a handle base 202, a handle cover plate 204, a handle body 206, and a handle axle (i.e., first axle) 210. The handle body 206 is substantially flat. The handle body 206 is provided with a hole 209. The hole 209 is disposed substantially perpendicular to the length direction of the handle body 206 and is configured to accommodate the handle axle 210. The front side of the handle base 202 is provided with a cavity 201. A wall 203 is formed around the cavity 201. The wall 203 is provided with a pair of holes 211 corresponding to the hole 209 on both sides. The holes 211 can also accommodate the handle axle 210. Through the cooperation between the handle axle 210, the hole 209 and the holes 211, the handle body 206 can be disposed in the cavity 201 of the handle base 202 and can be rotated about the rotational axis X of the handle axle 210. The handle cover plate 204 can be mounted on the handle body 206 by a connecting member, and together with the handle body 206, forms a handle 205. The handle 205 is rotatable relative to the handle base 202 about the rotational axis X of the handle axle 210 to achieve the state shown in FIGS. 1A to 1C.

The handle assembly 200 further comprises a motor 208, a rocker arm 212, a torsion spring 214, a slider 218, a first energizing device 224, a second energizing device 226, and a third energizing device (starting device) 222. With these components, the handle 205 is capable of achieving the three positional states shown in FIGS. 1A to 1C. The motor 208 is mounted in the cavity 217 on the lower-left side of the front surface of the handle base 202. The rocker arm 212, the torsion spring 214, the slider 218, the first energizing device 224, the second energizing device 226, and the third energizing device 222 are mounted on the reverse side of the handle base 202. Specifically, the intermediate position of the reverse side of the handle base 202 is provided with a rocker axle (second axle) 216 for being received by the hole 602 (see FIG. 6A) on the rocker arm 212, thereby mounting the rocker axle 216 on the handle base 202 and enabling the rocker arm 212 to rotate relative to the handle base 202 about the rotational axis Y of the rocker axle 216. The reverse side of the handle base 202 is further provided with a receiving hole 271 and a sliding cavity 273. The receiving hole 271 is located on the left side of the rocker axle 216 for receiving one end 272 of the torsion spring 214. The sliding cavity 273 is located on the lower side of the rocker axle 216 for receiving the slider 218 and enabling the slider 218 to slide along the length direction of the handle base 202.

Figure 4:
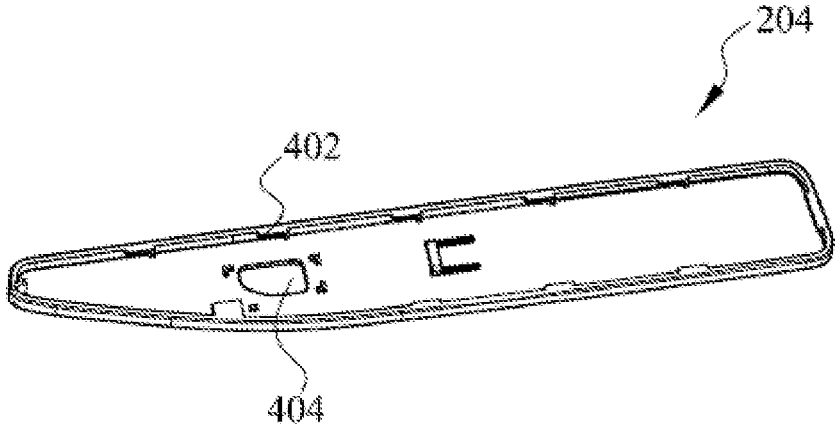
FIG. 4 is a perspective view of a handle cover plate 204 according to an embodiment of the present disclosure.

FIG. 4 is a perspective view of a handle cover plate 204 according to an embodiment of the present invention. As shown in FIG. 4, the handle cover plate 204 is provided with a connecting portion 402, and the connecting portion 402 can engage with the connected portion 502 (see FIG. 5A) on the handle body 206, thereby connecting the handle cover plate 204 with the handle body 206 to form the handle 205. As an example, the connecting portion 402 is a projection protruding from the handle cover plate 204, the connected portion 502 on the handle body 206 is a bayonet, and the projection can engage with the bayonet, so that the handle cover plate 204 and the handle body 206 are connected to form the handle 205.

The handle cover plate 204 can be further provided with an orifice 404 for setting the button 260 (see FIG. 2A). As an example, the button 260 can be connected to a control device (not shown) to send a back signal to the motor 208. As another example, the handle cover plate 204 may also be provided with no orifices 404, as will be described in detail later.

Figure 5A:
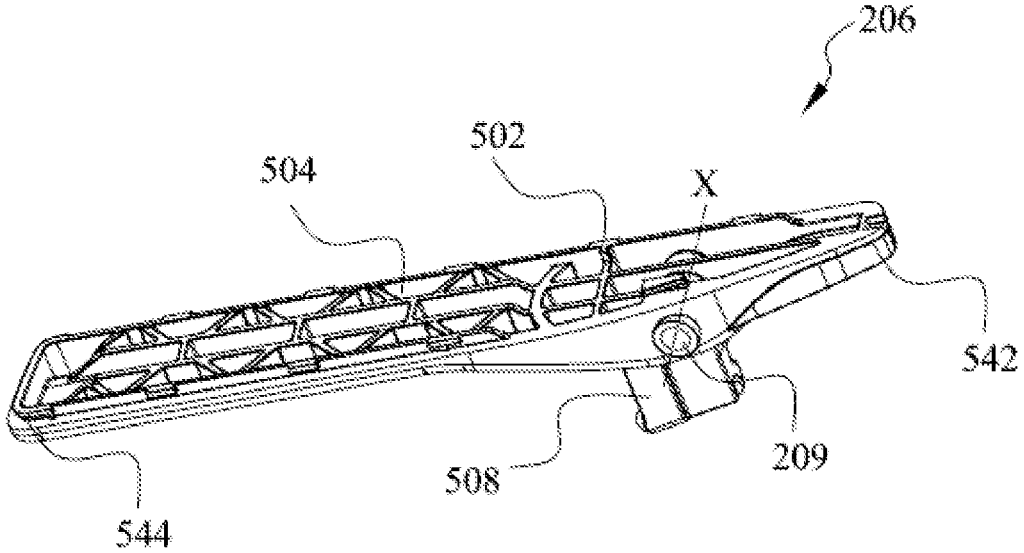
FIG. 5A is a perspective view of a handle body 206 according to an embodiment of the present disclosure.
Figure 5B:
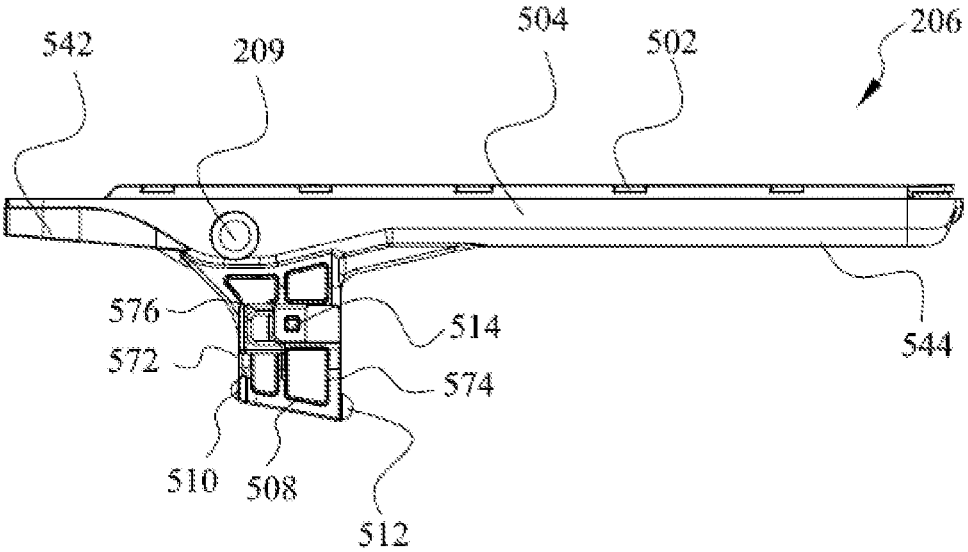
FIG. 5B is a front view of the handle body 206 shown in FIG. 5A.
Figure 5C:
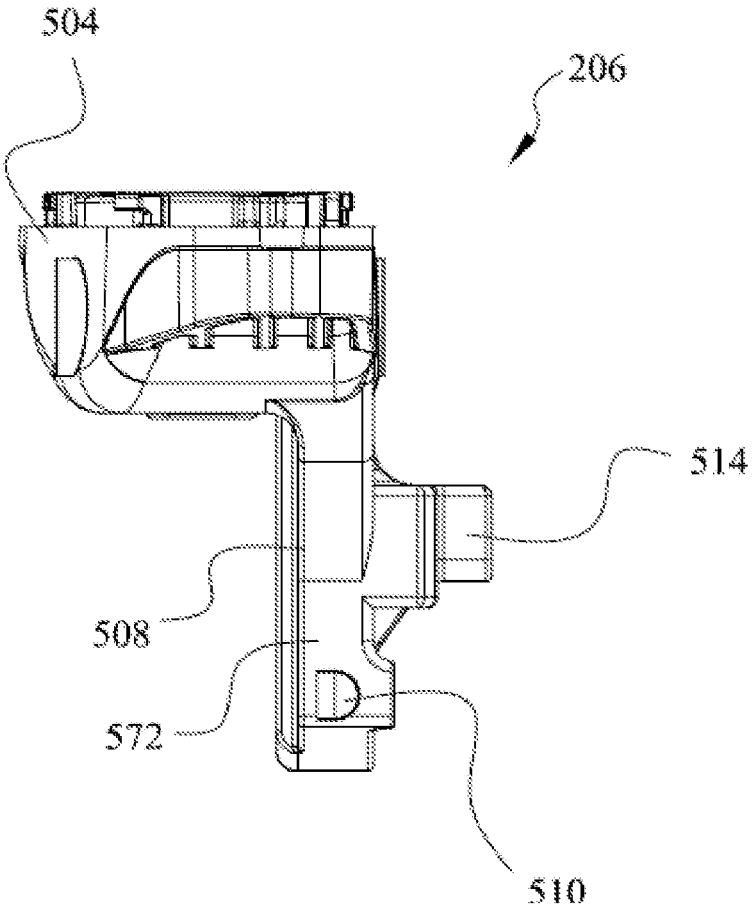
FIG. 5C is an enlarged lateral view of the handle body 206 shown in FIG. 5A.

FIG. 5A is a perspective view of the handle body 206 according to an embodiment of the present invention. FIG. 5B is a front view of the handle body 206 shown in FIG. 5A. FIG. 5C is an enlarged lateral view of the handle body 206 shown in FIG. 5A. As shown in FIGS. 5A to 5C, the handle body 206 comprises a flat portion 504. The flat portion 504 can have a certain thickness. The top of the flat portion 504 is provided with a connected portion 502 that engages with a connecting portion 402 on the handle cover plate 204 for coupling the handle cover plate 204 to the handle body 206. Holes 209 are also provided in the flat portion 504. The holes 209 are disposed generally perpendicular to the length direction of the handle body 206 for accommodating the handle axle 210, thereby enabling the handle body 206 to rotate about the rotational axis X of the handle axle 210. As an example, the position of the handle axle 210 can be positioned closer to one end 542 of the flat portion 504 and correspondingly away from the other end 544 of the flat portion 504. The holes 209 of the handle body 206, the holes 211 of the handle axle 210 and the handle base 202 are sized such that after the handle axle 210 passes through the holes 209, both ends of the handle axle 210 protrude from the handle body 206 in the width direction of the handle body 206, enabling both ends of the handle axle 210 protruding from the handle body 206 to be accommodated in the holes 211 of the handle base 202 so that the handle body 206 is mounted in the cavity 201 of the handle base 202 through the handle axle 210.

The handle body 206 further comprises a projection 508, and the projection 508 extends downwardly from the bottom surface of the flat portion 504. The flat portion 504 and the projection 508 cause the handle body 206 to be substantially T-shaped. The projection 508 comprises a first side 572 and a second side 574 that are disposed opposite each other, and a third side 576 that is adjacent to the first side 572 and the second side 574. The projection 508 comprises a contact portion 510 and a contact portion 512, the contact portion 510 being disposed on the first side 572 of the projection 508, the contact portion 512 being disposed on the second side 574 of the projection 508. The projection 508 further comprises a contact portion 514. The contact portion 514 extends outwardly from the third side 576 of the projection 508 perpendicular to the third side 576 such that the direction of extension of the contact portion 514 substantially coincides with the width direction of the handle body 206.

Figure 6A:
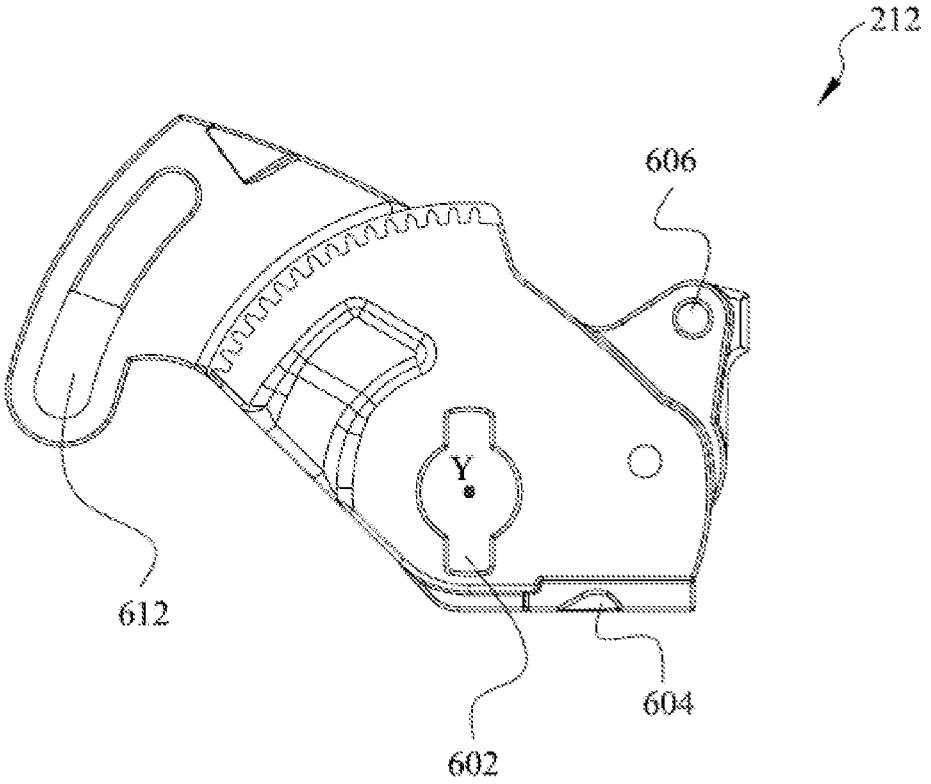
FIG. 6A is a front view of the rocker arm 212 according to an embodiment of the present disclosure.
Figure 6B:
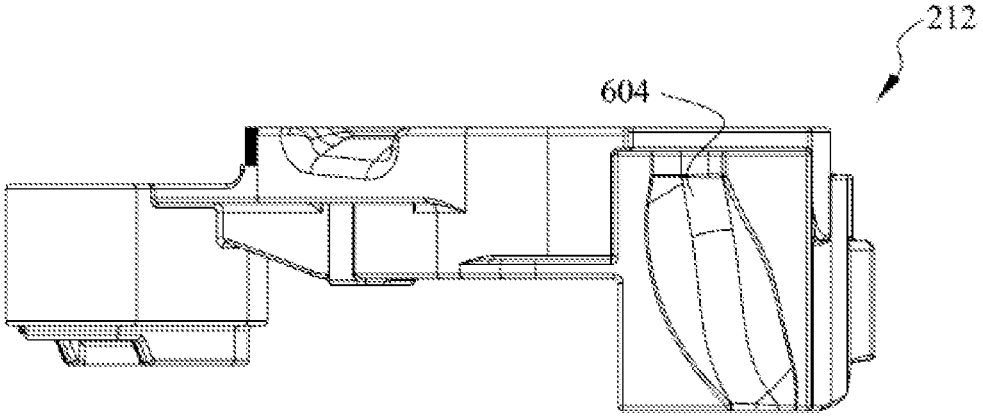
FIG. 6B is a view of the rocker arm 212 shown in FIG. 6A as viewed from the bottom up.

FIG. 6A is a front view of the rocker arm 212 according to an embodiment of the present invention. FIG. 6B is a view of the rocker arm 212 shown in FIG. 6A as viewed from the bottom up. As shown in FIGS. 6A and 6B, the rocker arm 212 comprises a hole 602 and a contact rail 604. The hole 602 is for accommodating the rocker axle 216 (see FIG. 2B) provided on the handle base 202 such that the rocker arm 212 is mounted on the handle base 202 and is rotatable about the rotational axis Y of the rocker axle 216. The contact rail 604 is disposed on a side of the rocker arm 212 and extends obliquely along the side of the rocker arm 212 by a certain length. The contact rail 604 is shaped to accommodate the contact portion 512 of the handle body 206 such that the contact portion 512 of the handle body 206 can remain in the contact rail 604 as the handle body 206 rotates.

When the handle body 206 is rotated from the handle body initial position to the handle body first open position or the handle body second open position, the contact portion 512 can move in the contact rail 604 as the handle body 206 rotates; thus, during the rotation of the handle body 206 about the rotational axis X, the handle body 206 can keep applying a force to the rocker arm 212, driving the rocker arm 212 to rotate about the rotational axis Y. Correspondingly, when the handle body 206 returns from the handle body first open position or the handle body second open position to the handle body initial position, the rocker arm 212 rotates about the rotational axis Y such that when the rocker arm 212 applies a force to the handle body 206, the portion 512 is movable along the contact rail 604, enabling the handle body 206 to rotate about the rotational axis X. The engagement of the contact rail 604 of the rocker arm 212 with the contact portion 512 of the handle body 206 is such that the movement of the handle body 206 driving the rocker arm 212 to rotate or the rocker arm 212 driving the handle body to rotate becomes smoother.

The rocker arm 212 further comprises a hole 606. The hole 606 is for accommodating one end 274 of the fixed torsion spring 214 so that a force can be applied to the torsion spring 214 when the rocker arm 212 is rotated, thereby causing the torsion spring 214 to generate a pre-tightening force or enabling the torsion spring 214 to apply a pre-tightening force to the rocker arm 212, so that the rocker arm 212 is rotated. In addition, the distal end 612 of the rocker arm 212 is also coupled to a bolt (not shown) by a cord (not shown). When the rocker arm 212 rotates, the rope can be pulled; when the rotation of the rocker arm 212 causes the handle 205 to reach a predetermined position (the rocker arm second open position), the bolt is completely pulled out for unlocking. As an example, the rocker arm 212 can be coupled to a damper device to allow a more uniform rotation of the rocker arm 212.

Figure 7A:
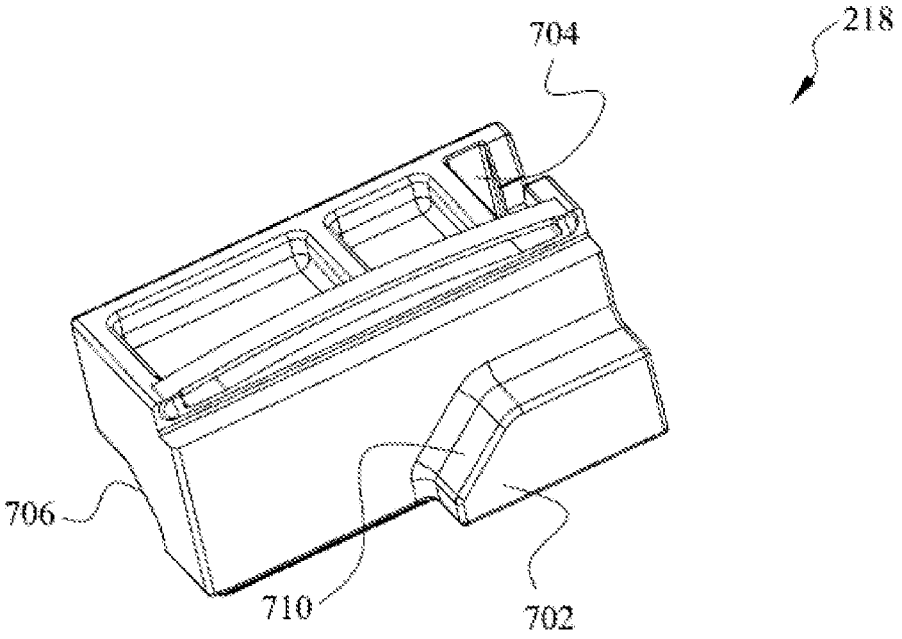
FIG. 7A is a perspective view of a slider 218 according to an embodiment of the present disclosure.
Figure 7B:
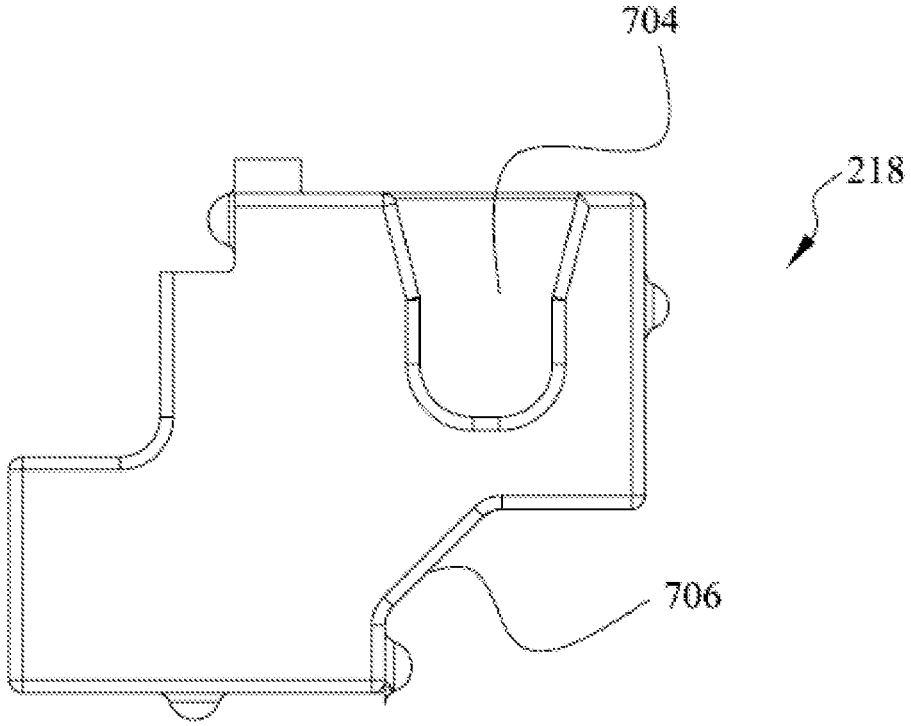
FIG. 7B is a view of the slider 218 shown in FIG. 5A as viewed from right to left.

FIG. 7A is a perspective view of a slider 218 according to an embodiment of the present invention. FIG. 7B is a view of the slider 218 of FIG. 7A as viewed from right to left. As shown in FIGS. 7A and 7B, the outer surface of the slider 218 comprises a sliding guide structure 706; the sliding guide structure 706 is recessed inwardly from the outer surface of the slider 218 toward the body of the slider 218. The slider 218 can be accommodated within the sliding cavity 273 (see FIG. 2B) of the handle base 202. The sliding guide structure 706 enables the slider 218 to move linearly in the handle base 202 along the length direction of the sliding cavity 273 (i.e., the length direction of the handle base 202).

The slider 218 further comprises a projection 702 and a recess 704. One end of the projection 702 is provided with a bevel 710; the bevel 710 can come into contact with the contact portion 514 of the handle body 206 such that the handle body 206 can rotate about the rotational axis X as the slider 218 moves linearly. The recess 704 is configured to accommodate one end of a drive rod 804 (see FIG. 8) of the motor 208 such that when the drive rod 804 of the motor 208 moves linearly, the slider 218 can move linearly with the drive rod 804 of the motor 208.

Figure 8:
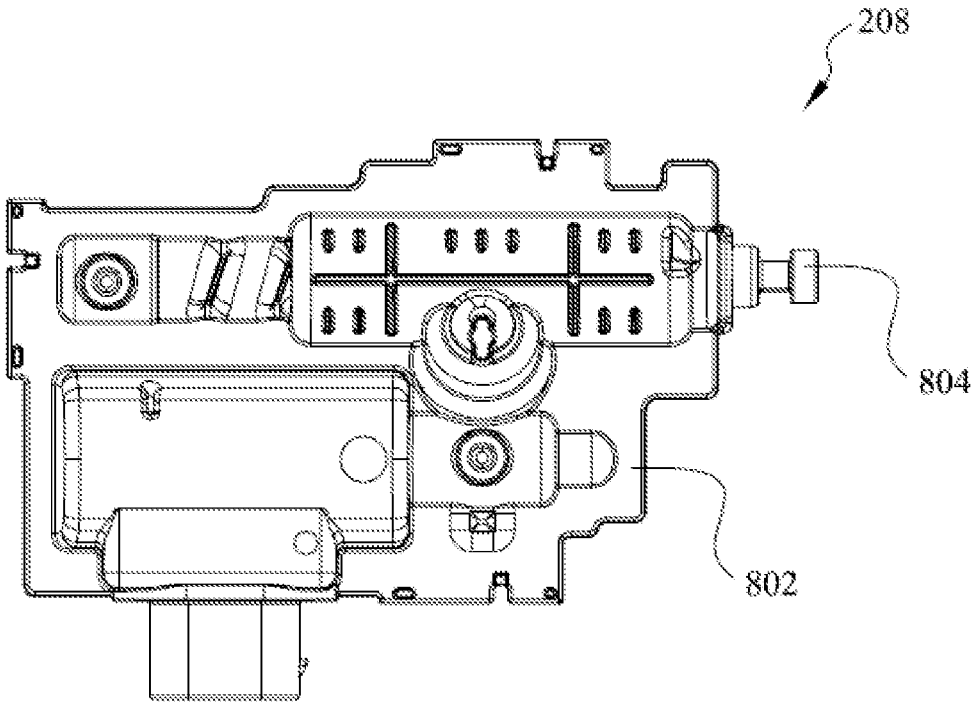
FIG. 8 is a front view of a motor 208 according to an embodiment of the present disclosure.

FIG. 8 is a front view of the motor 208 according to an embodiment of the present invention. As shown in FIG. 8, the motor 208 comprises a motor body 802 and a drive rod 804; the drive rod 804 of the motor 208 can be extended from the motor body 802 when the motor 208 receives a forward signal. When the motor 208 receives a back signal, the drive rod 804 of the motor 208 can return into the motor body 802.

Figure 9:
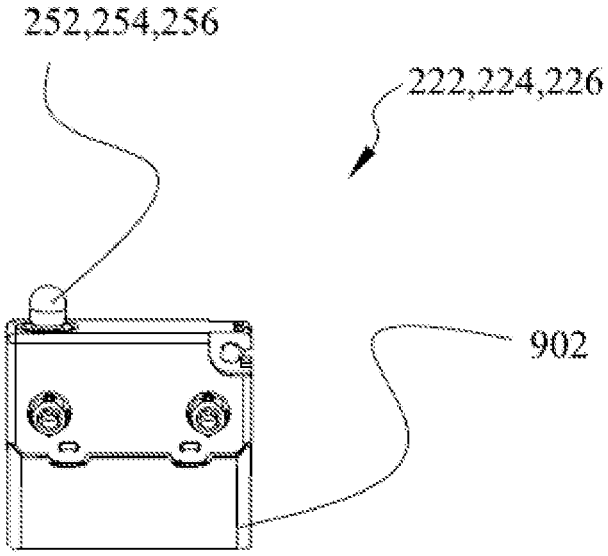
FIG. 9 is a front view of an energizing device according to an embodiment of the present disclosure.

FIG. 9 is a front view of an energizing device according to an embodiment of the present invention. As shown in FIG. 9, the energizing device comprises a body 902 and a triggering portion. When the triggering portion is energized, the energizing device can send a signal to a control device via a signal line. As an example, the energizing device can also send a signal to a control device (not shown) in a wireless manner. Specifically, the third energizing means (starting device) 222 is configured such that when the handle body 206 is rotated from the handle body initial position about the rotational axis X in a second direction (i.e., the direction indicated by the broken line B in FIG. 1C), the triggering portion 252 of the third energizing device 222 can be energized in contact with the contact portion 510 of the handle body 206. The first energizing device 224 is configured such that when the handle body 206 is rotated about the handle axle 210 in a first direction (i.e., the direction shown by the solid line A in FIG. 1A) to the handle body first open position, the triggering portion 254 of the first energizing device 224 can be energized in contact with the rocker arm 212. The second energizing device 226 is configured such that when the handle body 206 returns from the handle body first open position to the handle body initial position in a second direction, the triggering portion 256 of the second energizing device 226 can be energized in contact with the rocker arm 212.

Figure 10A:
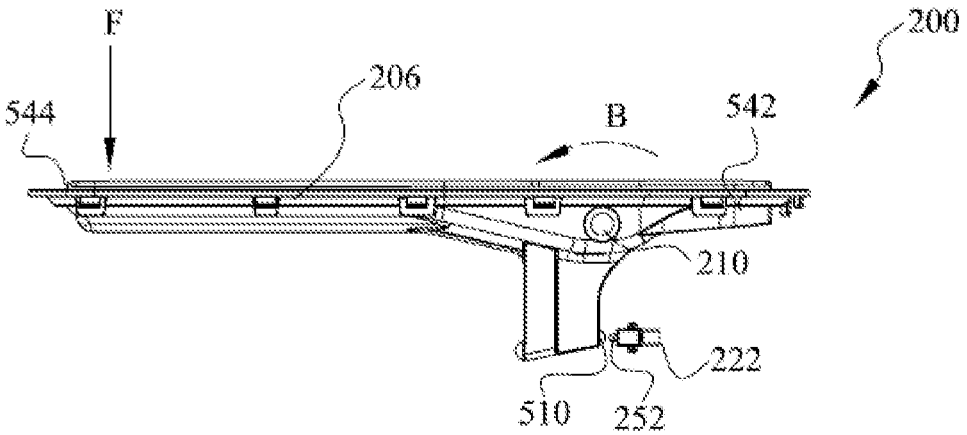
FIG. 10A is a schematic view of the handle body 206 of the handle assembly 200 shown in FIG. 2A in a handle body initial position.
Figure 10B:
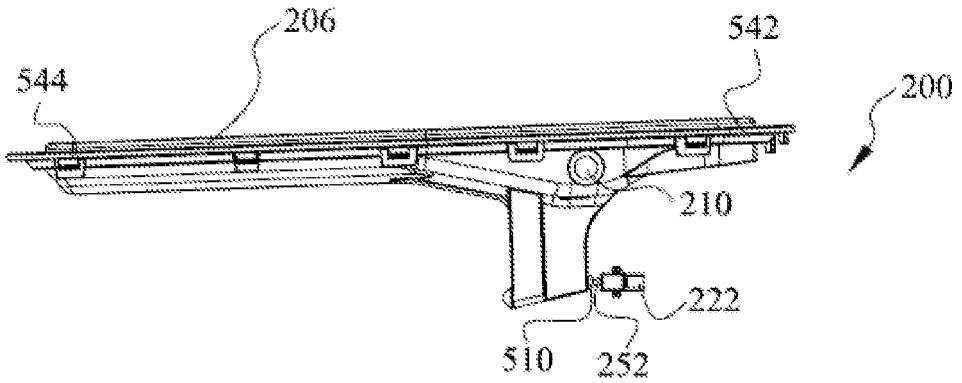
FIG. 10B is a schematic view of the handle body 206 shown in FIG. 2A triggering a third energizing device 222.

Various components in the handle assembly 200 according to an embodiment of the present invention will be detailed below. For ease of description, the direction in which the handle body 206 is rotated from the handle body initial position shown in FIG. 1A to the handle body first open position shown in FIG. 1B is defined as the first direction (see the solid line arrow A shown in FIGS. 1A to 1C), and the direction in which the handle body 206 is rotated from the handle body first open position shown in FIG. 1B to the handle body initial position shown in FIG. 1A is defined as the second direction (see the broken line arrow B shown in FIGS. 1A to 1C). The operation steps from FIG. 1A to FIG. 1B are as follows:

FIG. 10A is a schematic view of the handle body 206 of the handle assembly 200 shown in FIG. 2A in a handle body initial position; FIG. 10B is a schematic view of the handle body 206 shown in FIG. 2A triggering a third energizing device 222, thereby illustrating the process by which the contact portion 510 of the handle body 206 comes into contact with the contact portion 510 of the third energizing device 222. For ease of description herein, in FIGS. 10A and 10B, other components, such as the handle base 202 and the rocker arm 212, are not shown, and only the handle body 206 and the third energizing device 222 are shown.

As shown in FIG. 10A, the handle body 206 is in the handle body initial position. In this case, the handle cover plate 204 is flush with the door panel (not shown). To make the handle 205 to protrude from the door panel, the user can press the end 544 of the handle body 206. After the handle body 206 is pressed, it rotates in the second direction about the rotational axis X. After rotation by a certain angle, the contact portion 510 of the handle body 206 comes into contact with the triggering portion 252 of the third energizing device 222, and the third energizing device 222 sends a forward signal to the motor 208. As an example, the contact portion 510 according to the present invention is provided as a bump that is configured to, when the handle body 206 is rotated about the rotational axis X in the second direction, come into direct contact with the third energizing device 222 to send a signal.

Figure 10C:
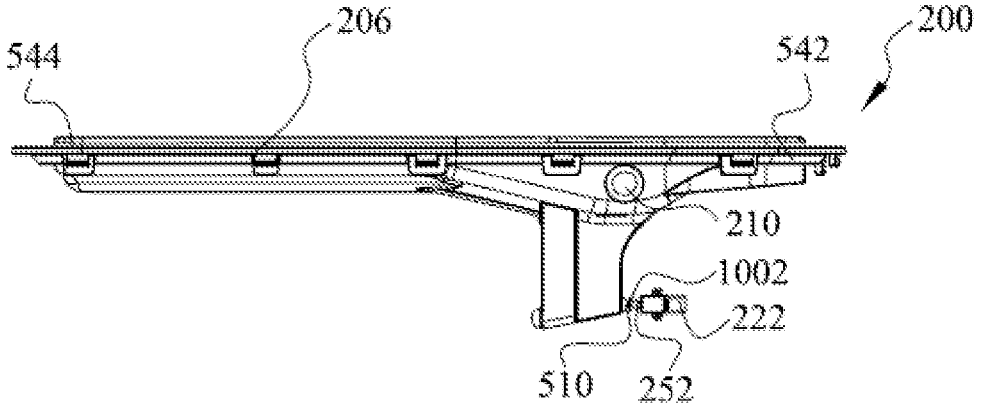
FIG. 10C is a schematic view of the handle body 206 in the handle body initial position according to another embodiment of the present disclosure.

FIG. 10C shows a schematic view of the handle body 206 in the handle body initial position according to another embodiment of the present invention. As shown in FIG. 10C, a metal plate 1002 is disposed between the contact portion 510 of the handle body 206 and the triggering portion 252 of the third energizing device 222. The metal plate 1002 is configured to be deformed when the handle body 206 is rotated about the rotational axis X in the second direction, such that the contact portion 510 can indirectly trigger the third energizing device 222. The provision of the metal plate 1002 not only protects the triggering portion 252 of the third energizing device 222, but also functions to adjust the stroke of the contact portion 510 by setting its deformation amount.

Figure 11A:
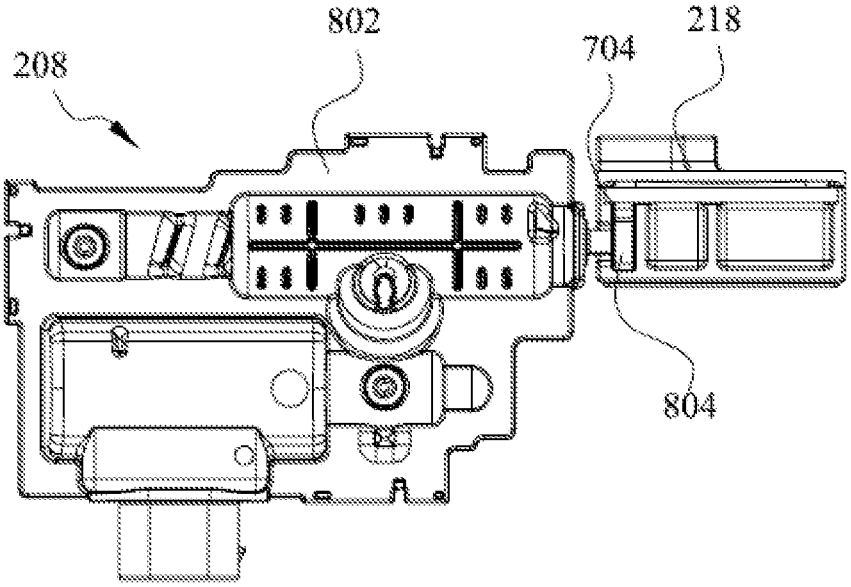
FIG. 11A is a front view of the motor 208 shown in FIG. 8 and the slider 218 shown in FIG. 7A with the handle body 206 in the handle body initial position.
Figure 11B:
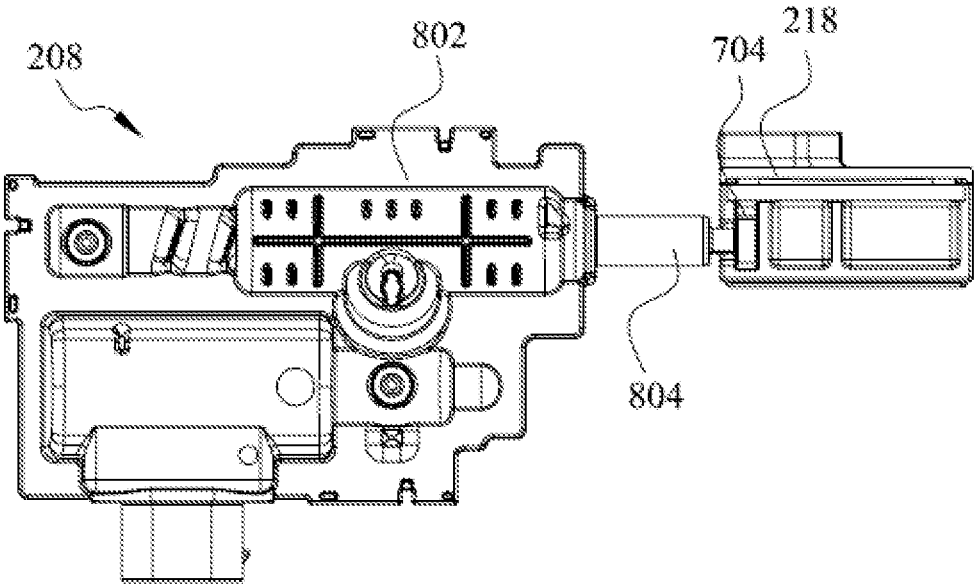
FIG. 11B is a front view of the motor 208 shown in FIG. 8 and the slider 218 shown in FIG. 7A with the handle body 206 in the handle body first open position.

FIG. 11A is a front view of the motor 208 shown in FIG. 8 and the slider 218 shown in FIG. 7A with the handle body 206 in the handle body initial position. FIG. 11B is a front view of the motor 208 shown in FIG. 8 and the slider 218 shown in FIG. 7A with the handle body 206 in the handle body first open position. As shown in FIGS. 11A and 11B, the distal end of the drive rod 804 of the motor 208 is received by the recess 704 of the slider 218. The motor 208 is accommodated in the cavity 217 of the handle base 202, the slider 218 is accommodated in the sliding cavity 273 of the handle base 202, and the slider 218 is slidable in the sliding cavity 273 along the length of the handle base 202. When the motor 208 receives a forward signal, the drive rod 804 of the motor 208 extends from the motor body 802. Since the motor body 802 is limited by the cavity 217, the motor body 802 remains motionless relative to the handle base 202, and the drive rod 804 extends from the motor body 802 and pushes the slider 218 to move linearly together.

Figure 12A:
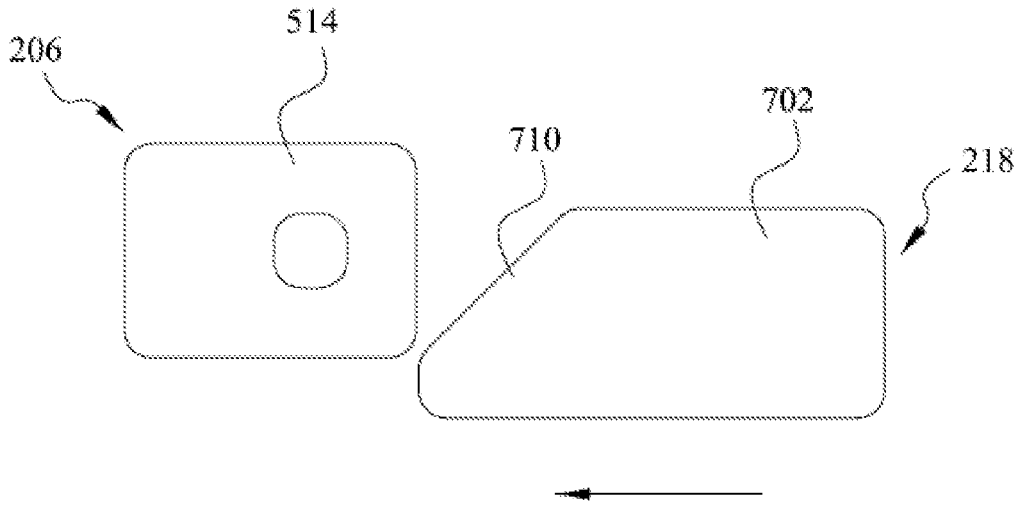
FIGS. 12A and 12B are schematic diagrams showing a simplified positional relationship of the contact portion 514 of the handle body 206 shown in FIG. 5A with the projection 702 of the slider 218 shown in FIG. 7A.
Figure 12B:
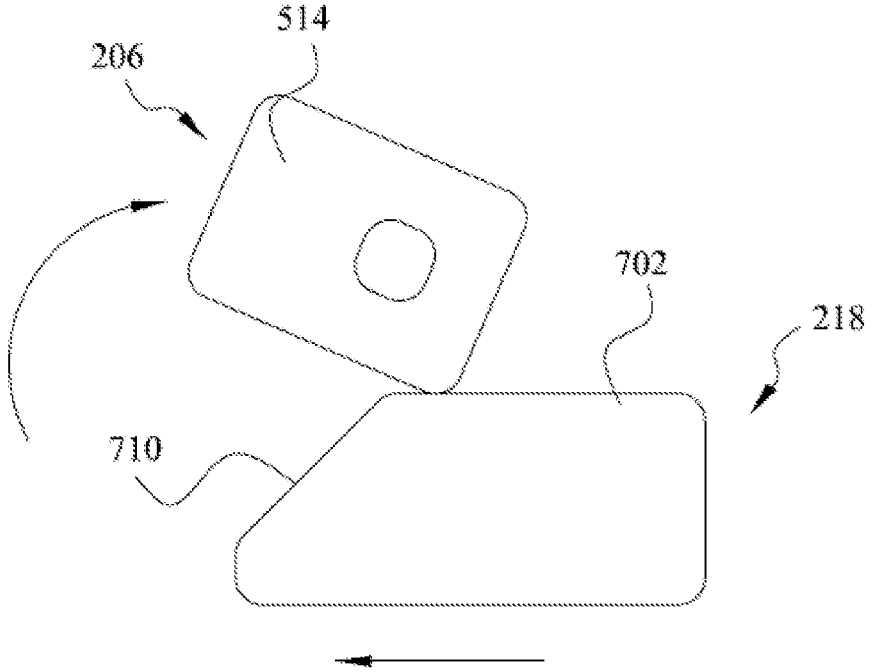
Figure 13A:
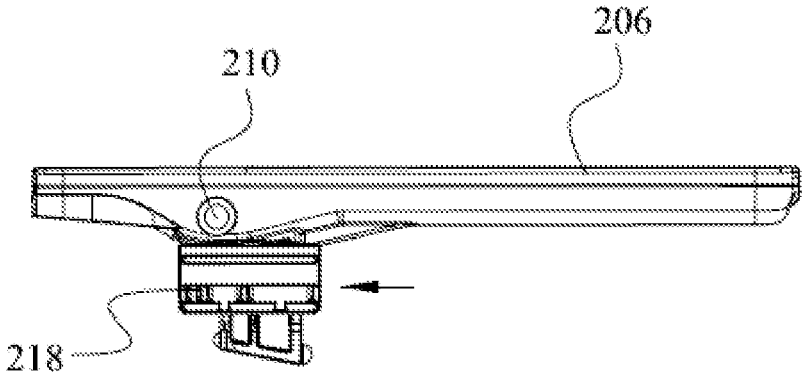
FIG. 13A is a diagram showing the positional relationship of the handle body 206 with the slider 218 when the handle body 206 shown in FIG. 5A has not yet pushed the slider 218 shown in FIG. 7A.
Figure 13B:
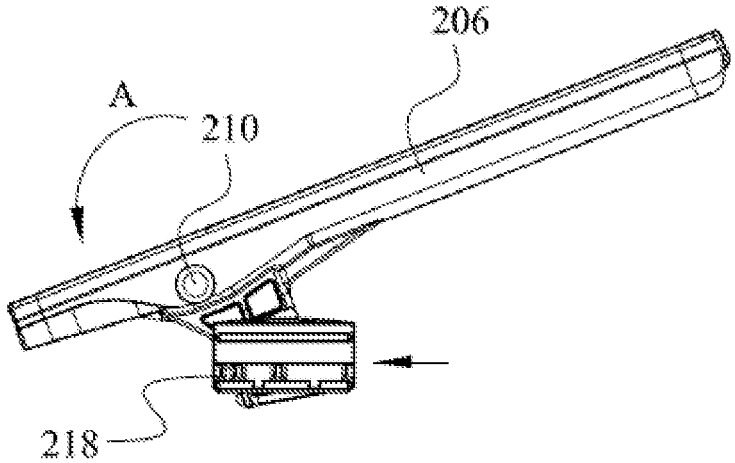
FIG. 13B is a diagram showing the positional relationship of the handle body 206 with the slider 218 shown in FIG. 7A when the handle body 206 shown in FIG. 5A is in the handle body first open position.

FIGS. 12A and 12B are schematic diagrams showing a simplified positional relationship of the contact portion 514 of the handle body 206 shown in FIG. 5A with the projection 702 of the slider 218 shown in FIG. 7A to illustrate the fitting relationship thereof. FIG. 13A is a diagram showing the positional relationship of the handle body 206 and the slider 218 when the handle body 206 shown in FIG. 5A has not yet pushed the slider 218 shown in FIG. 7A (in other words, the handle body 206 is in the handle body initial position). FIG. 13B is a diagram showing the positional relationship of the handle body 206 and the slider 218 shown in FIG. 7A when the handle body 206 shown in FIG. 5A is in the handle body first open position. As shown in FIGS. 12A to 12B and 13A to 13B, the projection 702 of the slider 218 is configured to have a bevel 710. When the slider 218 moves linearly, the bevel 710 abuts the contact portion 514 of the handle body 206. At this point, the slider 218 continues moving linearly and the slider 218 continues pushing the contact portion 514 of the handle body 206. Since the handle body 206 can only be rotated about the rotational axis X, the handle body 206 cannot be pushed by the slider 218 to move linearly with the slider 218, and thus the contact portion 514 moves upward along the bevel 710 under the pushing by the slider 218, thereby driving the handle body 206 to rotate about the rotational axis X in the first direction.

Figure 14:
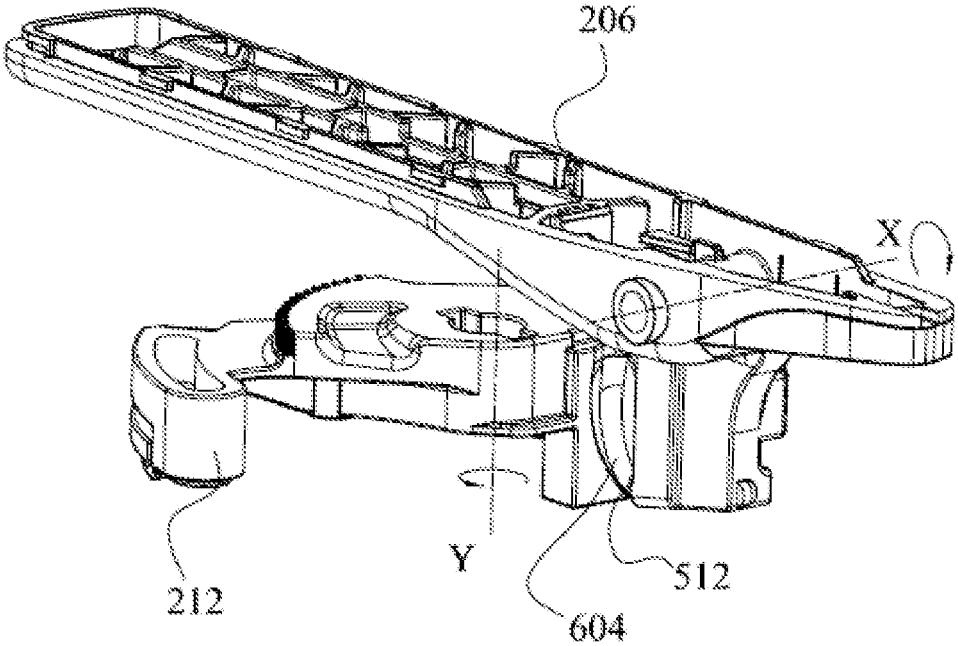
FIG. 14 shows a fitting relationship of the handle body 206 shown in FIG. 5A with the rocker arm 212 shown in FIG. 6A.

FIG. 14 shows a fitting relationship of the handle body 206 shown in FIG. 5A with the rocker arm 212 shown in FIG. 6A. As shown in FIG. 14, the rotational axis X of the handle body 206 is substantially perpendicular to the rotational axis Y of the rocker arm 212. The contact portion 512 of the handle body 206 is received by the contact rail 604 of the rocker arm 212. When the handle body 206 is pushed by the slider 218 to rotate about the rotational axis X, the contact portion 512 of the handle body 206 moves from the bottom upward along the track of the contact rail 604, thereby causing the rocker arm 212 to rotate outward about the rotational axis Y. When the rocker arm 212 is rotated by a first predetermined angle about the rotational axis Y from the rocker arm initial position, the rocker arm 212 reaches the rocker arm first open position and the handle body 206 reaches the handle body first open position. When the handle body 206 reaches the handle body first open position, the rocker arm 212 comes into contact with the triggering portion 254 of the first energizing device 224 (not shown in FIG. 14), the triggering portion 254 is energized and sends a stop signal to the motor 208, thereby stopping the motor 208. So far, the handle body 206 has been changed from the handle body initial position shown in FIG. 1A to the handle body first open position shown in FIG. 1B.

Figure 15:
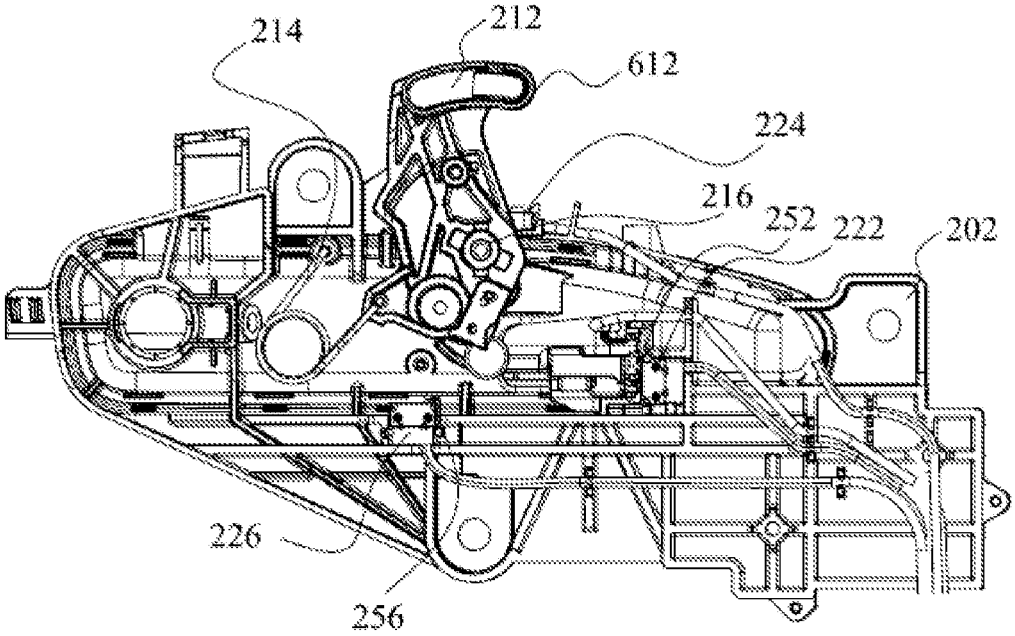
FIG. 15 is a rear view of the handle body 206 shown in FIG. 2A in a handle body first open position.

FIG. 15 is a rear view of the handle body 206 shown in FIG. 2A in the handle body first open position. As shown in FIG. 15, during the change from the handle body initial position shown in FIG. 1A to the handle body first open position shown in FIG. 1B, the rocker arm 212 rotates about the rotational axis Y of the rocker arm axle 216, and simultaneously the torsion spring 214 is tightened to apply a pre-tightening force to the torsion spring 214.

Returning now to FIG. 1B, as shown in FIG. 1B, an operating space 150 in which a hand can be extended is formed between the flat portion 504 of the handle body 206 in the handle body first open position and the door panel. In this case, the user can extend his/her hand into the operating space 150 and pull the flat portion 504 of the handle body 206 so that the handle body 206 continues to rotate about the rotational axis X in the first direction by a second predetermined angle, reaching the handle body second open position shown in FIG. 1C. As an example, the rotation of the handle body 206 from the handle body first open position to the handle body second open position may also be generated by other externally applied forces.

Figure 16:
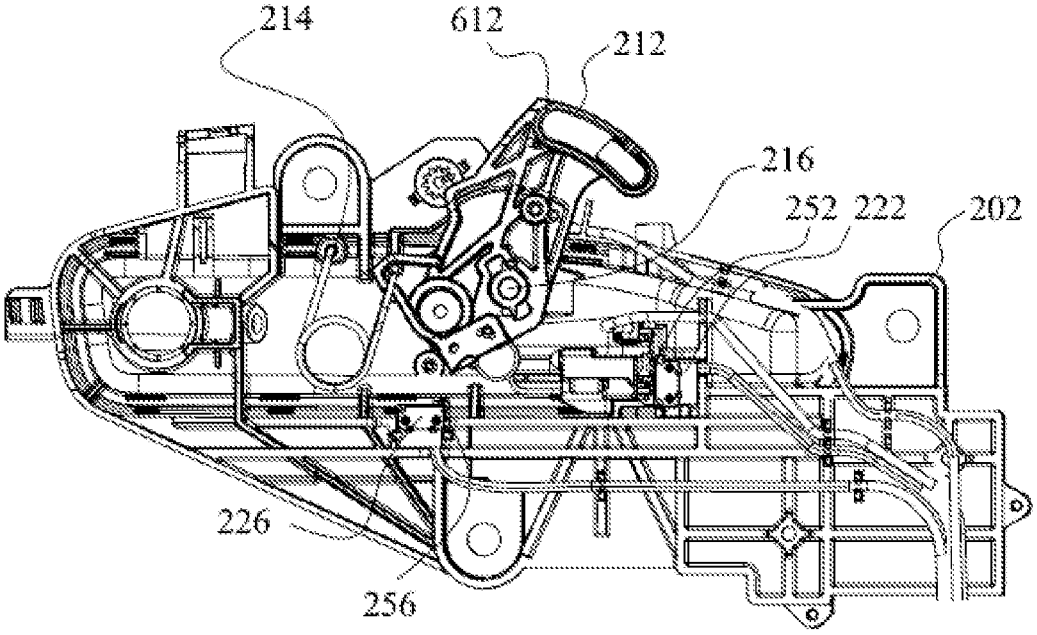
FIG. 16 is a rear view of the handle body 206 shown in FIG. 2A in a handle body second open position.

FIG. 16 is a rear view of the handle body 206 shown in FIG. 2A in the handle body second open position. As shown in FIG. 16, during the change from the handle body first open position shown in FIG. 1B to the handle body second open position shown in FIG. 1C, the rocker arm 212 continues rotating about the rotational axis Y and continues tightening the torsion spring 214. The rocker arm 212 is also coupled to a bolt (not shown) by a cord (not shown) that is pulled when the handle body 206 is pulled and the rocker arm 212 continues rotating; when the handle body 206 is rotated to the handle body second open position, the rocker arm 212 is rotated to the rocker arm second open position, and the bolt is completely pulled out to unlock. As an example, the bolt can be coupled to the rocker arm end 612 that is further from the rocker arm axle 216 (rotational axis Y) such that the amount of movement is maximized during pulling of the bolt. As another example, the rocker arm 212 may also be coupled to the bolt without a cord, and another actuation mechanism is used to unlock the bolt.

Upon completion of the unlocking action, the user releases the flat portion 504 of the handle body 206 (in other words, the user withdraws the hand from the operating space 150). The pre-tightening force on the torsion spring 214 applies a reverse deflection force to the rocker arm 212, forcing the rocker arm 212 to rotate from the rocker arm second open position to the rocker arm first open position, and causing the handle body 206 to return from the handle body second open position to the handle body first open position. When the handle body 206 has returned to the handle body first open position, the user can push the button (return device) 260 (see FIG. 2A). The button 260 sends a back signal to the motor 208. Then, the motor 208 starts retreating linearly, driving the slider 218 to move linearly together. The process of returning the handle body 206 from the handle body first open position to the handle body initial position is opposite to the process of changing the handle body 206 from the handle body initial position to the handle body first open position, and therefore will not be described herein again.

The difference between the above two processes is that when the handle body 206 is changed from the handle body initial position to the handle body first open position, the motor 208 moves forward to tighten the torsion spring 214; when the handle body 206 is changed from the handle body first open position to the handle body initial position, the motor 208 moves backward while the pre-tightening force of the torsion spring 214 is released, thereby helping the handle body 206 to return to the handle body initial position. When the handle body 206 returns to the handle body initial position, the rocker arm 212 comes into contact with the triggering portion 256 of the second energizing device 226, thereby energizing the second energizing device 226 to send a stop signal to the motor 208, thereby stopping the motor 208. At this point, the handle body 206 is restored to the handle body initial position.

As another example, the handle cover plate 204 of the handle assembly 200 may also have no orifices 404. In other words, the button 260 is not required on the handle cover plate 204. To achieve this function, the slider is configured to be in another form and the actuating device 1502 is added.

Figure 17:
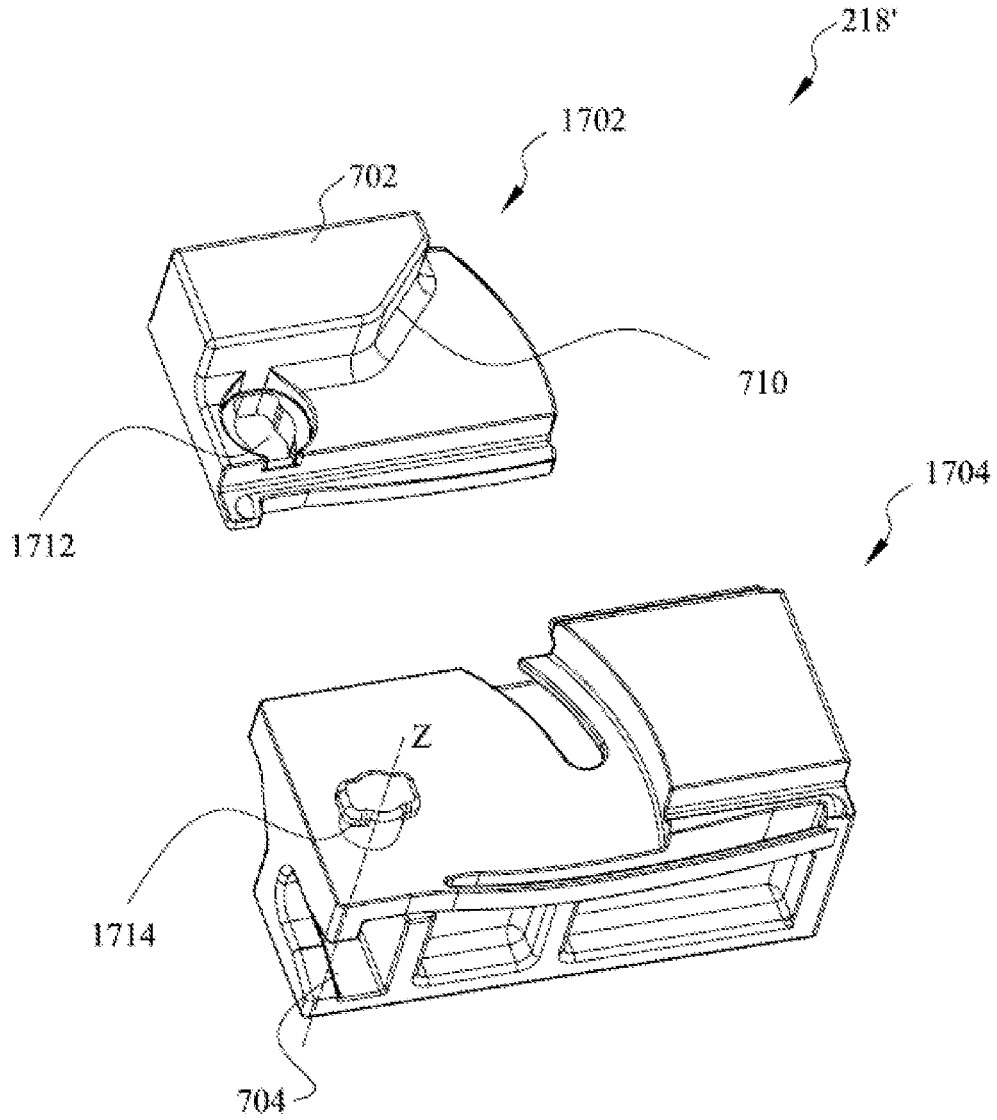
FIG. 17 is a perspective view of a slider 218' according to another embodiment of the present disclosure.

FIG. 17 is a perspective view of a slider 218' according to another embodiment of the present invention. As shown in FIG. 17, the slider 218' comprises an additional rotating block 1702 and a slider holder 1704. The additional rotating block 1702 is provided with a hole 1712, and the slider holder 1704 is provided with a fixed axle (third axle) 1714. The hole 1712 can accommodate the fixed axle 1714 such that the additional rotating block 1702 can be mounted to the slider block 1704 and rotated about the rotational axis Z of the fixed axle 1714. The additional rotating block 1702 further comprises a projection 702. The projection 702 comprises a bevel 710. The projection 702 is configured to be engageable with the contact portion 514 of the handle body 206 such that a force is applied to the handle body 206 as the slider 218 moves linearly toward the contact portion 514 of the handle body 206, thereby causing the handle body 206 to rotate about the rotational axis X. The slider holder 1704 comprises a recess 704; the recess 704 is configured to accommodate one end of a drive rod 804 of the motor 208 such that when the drive rod 804 of the motor 208 moves linearly, the slider 218' can move linearly together with the drive rod 804 of the motor 208.

The difference between the handle assembly using the slider 218' of the present embodiment and the handle assembly using the slider 218 in the above-mentioned embodiment is that the handle body 206 is returned from the handle body first open position to the handle body initial position not by pressing the button 260, but in a manner to be explained in detail below. Therefore, only how the handle body 206 is returned from the handle body first open position to the handle body initial position will be described herein, and no other process will be described again.

Figure 18:
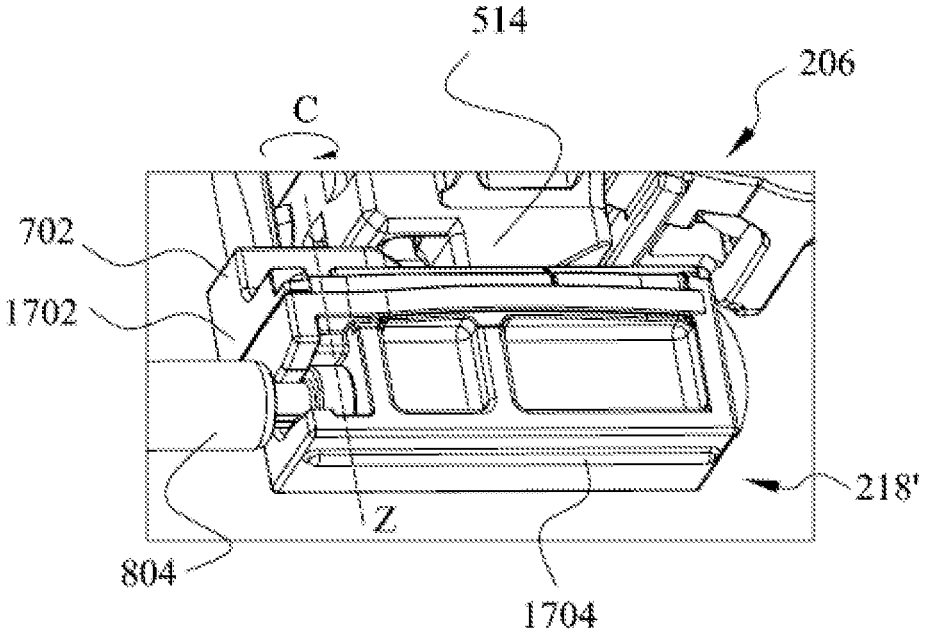
FIG. 18 is a partial enlarged view of the fitting relationship of the slider 218' shown in FIG. 17 with the contact portion 514 of the handle body 206.

FIG. 18 is a partial enlarged view of the fitting relationship of the slider 218' shown in FIG. 17 with the contact portion 514 of the handle body 206. FIG. 18 shows a view from the front side of the slider holder 1704 shown in FIG. 17 after the additional rotating block 1702 is mounted on the slider holder 1704. In FIG. 18, the bevel 710 of the projection 702 of the additional rotating block 1702 is located below the contact portion 514 of the handle body 206 so as to be blocked by the contact portion 514 of the handle body 206 and is not visible. The position of the rotational axis Z of the fixed axle 1714 of the slider holder 1704 is shown by a broken line in FIG. 18, and the additional rotating block 1702 is rotatable inward about the rotational axis Z in the direction indicated by the arrow C.

Specifically, after pulling the flat portion 504 of the handle body 206 to complete the unlocking action, the user releases the flat portion 504 of the handle body 206 (in other words, the user withdraws the hand from the operating space 150). The pre-tightening force of the torsion spring 214 forces the handle body 206 and the rocker arm 212 to rotate in opposite directions about their respective rotational axis, so that the handle body 206 returns from the handle body second open position to the handle body first open position. Then, as shown in FIG. 18, after the handle body 206 returns to the handle body first open position, the user can press one end 544 of the handle cover plate 204. Since no start signal is sent to the motor 208, the drive rod 804 of the motor 208 still abuts the slider 218' such that although the user's hand applies a force to the handle body 206, the slider 218' cannot move linearly. Thus, when the handle body 206 is pressed by the user, the contact portion 514 of the handle body 206 pushes the projection 702 of the additional rotating block 1702 of the slider 218' such that the additional rotating block 1702 is rotated relative to the slider holder 1704 about the rotational axis Z.

Figure 19:
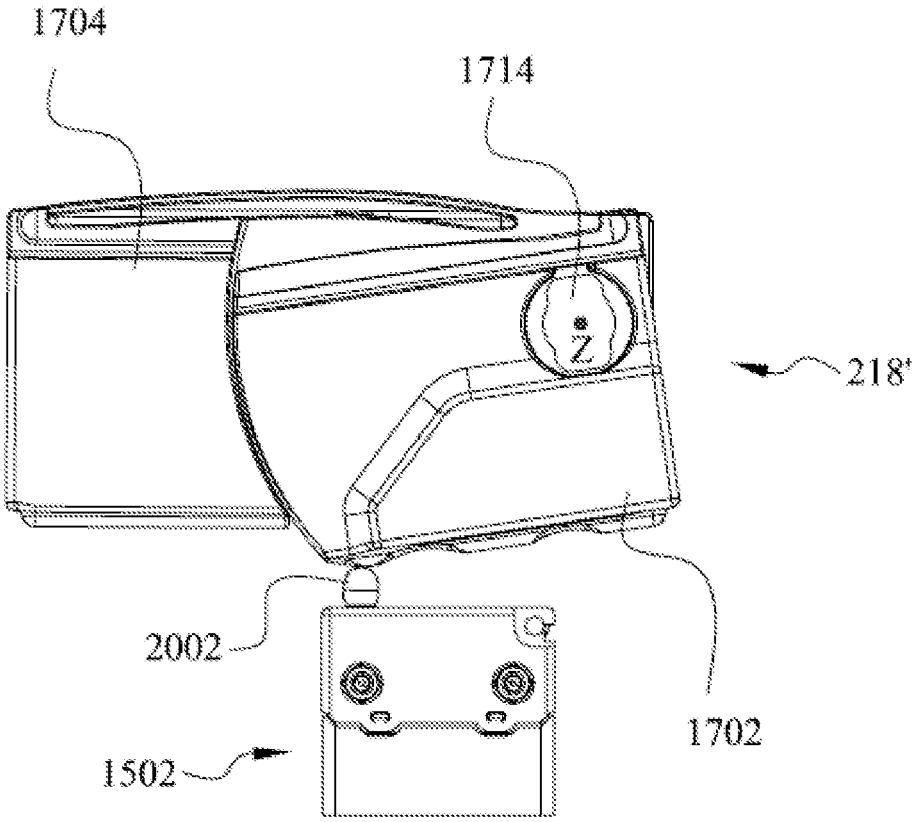
FIG. 19 shows a fitting relationship of the slider 218' shown in FIG. 17 with an actuating device 1502.

FIG. 19 shows a fitting relationship of the slider 218' shown in FIG. 17 with an actuating device 1502. As shown in FIG. 19, when the additional rotating block 1702 is rotated about the rotational axis Z, the additional rotating block 1702 will come into contact with the triggering portion 1902 of the actuating device 1502. The triggering portion 1902 is energized and sends a back signal to the motor 208. Then, as described above, the motor 208 moves backward while the pre-tightening force of the torsion spring 214 is released to return the handle body 206 from the handle body first open position to the handle body initial position.

It should be noted that the motor 208 is used as a driving device in the present invention; however, as an example, another driving device may be used, as long as the driving device is configured to drive the handle body 206 to rotate about the rotational axis X, thereby driving the rocker arm 212. It will also be appreciated that while an actuating device in the present invention is a contact sensor, in other examples, other forms of actuating devices may be used instead.

A concealed handle assembly according to the present invention can realize the opening or returning of a handle body by using only one rocker arm. Therefore, a concealed handle assembly according to the present invention has a simple structure, which allows easier installation and makes the operation of the handle assembly simpler and more reliable.

While certain features of the present invention have been particularly described above with reference to drawings and preferred embodiments, it should be understood that those of ordinary skill in the art can make various substitutions and improvements without departing from the spirit and scope of the present invention as defined by the Claims.

We claim:

1. A concealed handle assembly, comprising:

a handle base;

a first axle disposed on the handle base;

a handle body, the handle body being rotatable about the first axle such that a first end of the handle body can extend or return to a concealed state, the handle body having a handle body initial position, a handle body first open position, and a handle body second open position;

a rocker arm, the rocker arm being rotatable about a second axle, the second axle being disposed on the handle base, the rocker arm having a rocker arm initial position, a rocker arm first open position, and a rocker arm second open position, the rocker arm being capable of being rotated away from or returned to the rocker arm initial position as the handle body rotates, the rocker arm being capable of driving a bolt; and a slider comprising a rotating block and a slider holder, the rotating block being disposed on the slider holder, the rotating block comprising a bevel, and the slider being configured to push the handle body such that the handle body rotates from the handle body initial position to the handle body first open position, wherein rotation of the handle body from the handle body first open position to the handle body initial position is initiated by an external force, wherein, the external force causes the handle body to rotate the rotating block, wherein, when the rocker arm is rotated by a first predetermined angle in a first direction from the rocker arm initial position, the handle body reaches the handle body first open position, and wherein, when the rocker arm continues to rotate by a second predetermined angle in the first direction from the first predetermined angle, the handle body reaches the handle body second open position, wherein when the handle body is in the handle body second open position, the rocker arm can drive the bolt to unlock.

2. The concealed handle assembly of claim 1 further comprising:

a driving device, the driving device being capable of driving the handle body to rotate about the first axle, thereby driving the rocker arm to rotate; and a first energizing device, the first energizing device being configured to, when the rocker arm is rotated from the rocker arm initial position to the rocker arm first open position, generate a stop signal, thereby stopping the driving device.

3. The concealed handle assembly as claimed in claim 2, wherein the concealed handle assembly further comprises:

a second energizing device, the second energizing device being configured to, when the rocker arm returns from the rocker arm first open position to the rocker arm initial position, generate a second stop signal, thereby stopping the driving device.

4. The concealed handle assembly as claimed in claim 3, wherein the first energizing device and the second energizing device are contact sensors.

5. The concealed handle assembly as claimed in claim 2, wherein the slider is driven by the driving device and the slider is configured to push the handle body such that the handle body rotates from the handle body initial position to the handle body first open position.

6. The concealed handle assembly as claimed in claim 5, wherein the bevel is in contact with the handle body such that the handle body is rotatable about the first axle when the slider is linearly moved.

7. The concealed handle assembly as claimed in claim 6, wherein the rotating block is linearly movable with the slider holder, enabling the handle body to rotate about the first axle along the bevel;

wherein, application of the external force to the handle body to rotate the rotating block starts the driving device; and wherein when the driving device is started, the driving device returns the handle body from the handle body first open position to the handle body initial position.

8. The concealed handle assembly as claimed in claim 7, wherein the slider holder is provided with a third axle, the rotating block being disposed on the slider holder, the rotating block being rotatable about the third axle.

9. The concealed handle assembly as claimed in claim 2, wherein the handle assembly further comprises:

a starting device, the starting device being configured to start the driving device in response to an external force applied to the handle body.

10. The concealed handle assembly as claimed in claim 2, wherein the handle assembly further comprises:

a returning device, the returning device being configured to start the driving device in response to an external force applied to the returning device, so that the handle body returns from the handle body first open position to the handle body initial position.

11. The concealed handle assembly as claimed in claim 2, wherein the driving device is a motor.

12. The concealed handle assembly as claimed in claim 1, wherein the concealed handle assembly further comprises:

a torsion spring, the torsion spring being configured to apply a deflection force to the rocker arm, a first end of the torsion spring being connected to the handle base and a second end to the rocker arm.

13. The concealed handle assembly as claimed in claim 1, wherein the handle body comprises a contact portion, the contact portion being in contact with the rocker arm such that when the handle body is rotated, the handle body applies a rotational force to the rocker arm.

14. A concealed handle assembly, comprising:

a handle base;

a handle body, the handle body being rotatable about a first axle such that one end of the handle body can extend or return to a concealed state, the first axle being disposed on the handle base, the handle body having a handle body initial position, a handle body first open position, and a handle body second open position;

a rocker arm, the rocker arm being rotatable about a second axle, the second axle being disposed on the handle base, the rocker arm having a rocker arm initial position, a rocker arm first open position, and a rocker arm second open position, the rocker arm being capable of being rotated away from or returned to the rocker arm initial position as the handle body rotates, the rocker arm being capable of driving a bolt;

a driving device, the driving device being capable of driving the handle body to rotate about the first axle, thereby driving the rocker arm to rotate;

a first energizing device, the first energizing device being configured to, when the rocker arm is rotated from the rocker arm initial position to the rocker arm first open position, generate a stop signal, thereby stopping the driving device; and a slider comprising a rotating block and a slider holder, the rotating block being disposed on the slider holder, the rotating block comprising a bevel, the slider being driven by the driving device and the slider being configured to push the handle body such that the handle body rotates from the handle body initial position to the handle body first open position, wherein, when the rocker arm is rotated by a first predetermined angle in a first direction from the rocker arm initial position, the handle body reaches the handle body first open position, wherein, when the rocker arm continues to rotate by a second predetermined angle in the first direction from the first predetermined angle, the handle body reaches the handle body second open position, in the handle body second open position the rocker arm can drive the bolt to unlock, wherein the bevel is in contact with the handle body such that the handle body is rotatable about the first axle when the slider is linearly moved, wherein the rotating block is linearly movable with the slider holder, enabling the handle body to rotate about the first axle along the bevel, and when it is desired to return the handle body from the handle body first open position to the handle body initial position, an external force can be applied to the handle body to cause the handle body to rotate the rotating block, thereby starting the driving device, so that the handle body returns from the handle body first open position to the handle body initial position.

15. The concealed handle assembly as claimed in claim 14, wherein the concealed handle assembly further comprises:

a second energizing device, the second energizing device being configured to, when the rocker arm returns from the rocker arm first open position to the rocker arm initial position, generate a stop signal, thereby stopping the driving device.

16. The concealed handle assembly as claimed in claim 14, wherein the concealed handle assembly further comprises:

a torsion spring, the torsion spring being configured to apply a deflection force to the rocker arm, one end of the torsion spring being connected to the handle base and the other end to the rocker arm.

17. The concealed handle assembly as claimed in claim 14, wherein rotation of the handle body from the handle body first open position to the handle body second open position is generated by a force applied from outside the concealed handle assembly.

18. The concealed handle assembly as claimed in claim 14, wherein the handle body comprises a contact portion, the contact portion being in contact with the rocker arm such that when the handle body is rotated, the handle body applies a rotational force to the rocker arm.

19. The concealed handle assembly as claimed in claim 14, wherein the handle assembly further comprises:

a starting device, the starting device being configured to start the driving device in response to an external force applied to the handle body.

20. The concealed handle assembly as claimed in claim 14, wherein the handle assembly further comprises:

a returning device, the returning device being configured to start the driving device in response to an external force applied to the returning device, so that the handle body returns from the first open position to the initial position.

* * * * *